United States Patent [19]

Hamada et al.

[11] 4,311,304

[45] Jan. 19, 1982

[54] PRESENSITIZED PLATE HANDLING DEVICE

[75] Inventors: Shinji Hamada; Masaru Imai, both of Minami-ashigara, Japan

[73] Assignee: Fuji Photo Film Co., Ltd., Kanagawa, Japan

[21] Appl. No.: 78,846

[22] Filed: Sep. 25, 1979

[30] Foreign Application Priority Data

Sep. 29, 1978 [JP] Japan ..... 53-133958[U]
Oct. 11, 1978 [JP] Japan ..... 53-139288[U]

[51] Int. Cl.[3] ..... B65H 5/08

[52] U.S. Cl. ..... 271/13; 271/236; 271/227; 271/91; 414/121

[58] Field of Search ..... 271/227, 248, 250, 11, 271/12, 106, 107, 91, 92, 13, 236; 414/117, 118, 121; 198/456; 221/210–212

[56] References Cited

U.S. PATENT DOCUMENTS

| | | | |
|---|---|---|---|
| 2,941,799 | 6/1960 | Reincke | 271/92 |
| 3,322,301 | 5/1967 | Bliss | 271/106 |
| 3,588,090 | 6/1971 | Huston et al. | 271/227 |
| 3,603,446 | 9/1971 | Maxey et al. | 271/227 |
| 3,826,485 | 7/1974 | Shindo | 414/121 |
| 3,897,945 | 8/1975 | Faltot et al. | 271/227 |
| 3,912,253 | 10/1975 | Jarman | 414/121 |

*Primary Examiner*—H. Grant Skaggs
*Attorney, Agent, or Firm*—Gerald J. Ferguson, Jr.; Joseph J. Baker

[57] ABSTRACT

A large number of presensitized plates are stacked on a platform. The platform is controlled to lift the stack of presensitized plates so that the uppermost presensitized plate in the stack is always positioned at a predetermined level. Sucking members suck the uppermost plate and lift it away from the rest of the stack. The lifted plate is placed on a plurality of parallel endless belts and transferred to a printing section. The plate is positioned in two dimensions with respect to the printing section on the way thereto.

8 Claims, 13 Drawing Figures

PRESENSITIZED PLATE HANDLING DEVICE

BACKGROUND OF THE INVENTION

1. Field of the Invention

This invention relates to a presensitized plate handling device for feeding presensitized plates one by one from a stack thereof to a desired section of a printing system.

2. Description of the Prior Art

As is well known in the art, presensitized plates (hereinafter referred to as a PS plate) comprise a base member and a photosensitive layer carried thereon. The base member is generally of plastic film, paper or aluminum and aluminum-based PS plates have come into particularly wide use recently. The operation of handling large numbers of aluminum-based PS plates presents difficulties which derive from the weight of the individual plates, which is larger than that of a plastic-film-based or paper-based PS plate. Thus, the development of a handling device for feeding PS plates one by one from a stack thereof to desired section on a printing system has been anxiously awaited.

SUMMARY OF THE INVENTION

Accordingly, the primary object of the present invention is to provide a PS plate handling device which separates PS plates one by one from a stack thereof and feeds them to a desired section of a printing system, for example, to the printing section or the developing section.

The PS plate handling device of the present invention comprises a platform for supporting a stack of PS plates thereon, a lifting means for lifting the platform so that the uppermost PS plate in the stack is always positioned at a predetermined level as the PS plates are removed from the stack one by one, a sucking and separating means for separating the PS plates from the stack one by one and a transferring and positioning means which transfers the separated PS plates to the desired section in a printing system and precisely positions them with respect to the section.

In a preferred embodiment of the present invention, the separated PS plate is positioned in one direction by bringing one side edge of the PS plate into engagement with a pair of spaced conductive stopper members disposed on one side of the path of transfer of the PS plate, and positioned in the other direction by means of a pair of spaced conductive stopper members disposed in the path of transfer. When each pair of conductive stoppers are electrically connected, it is considered that the PS plate has been positioned.

DESCRIPTION OF THE PREFERRED EMBODIMENTS

Figure 1:
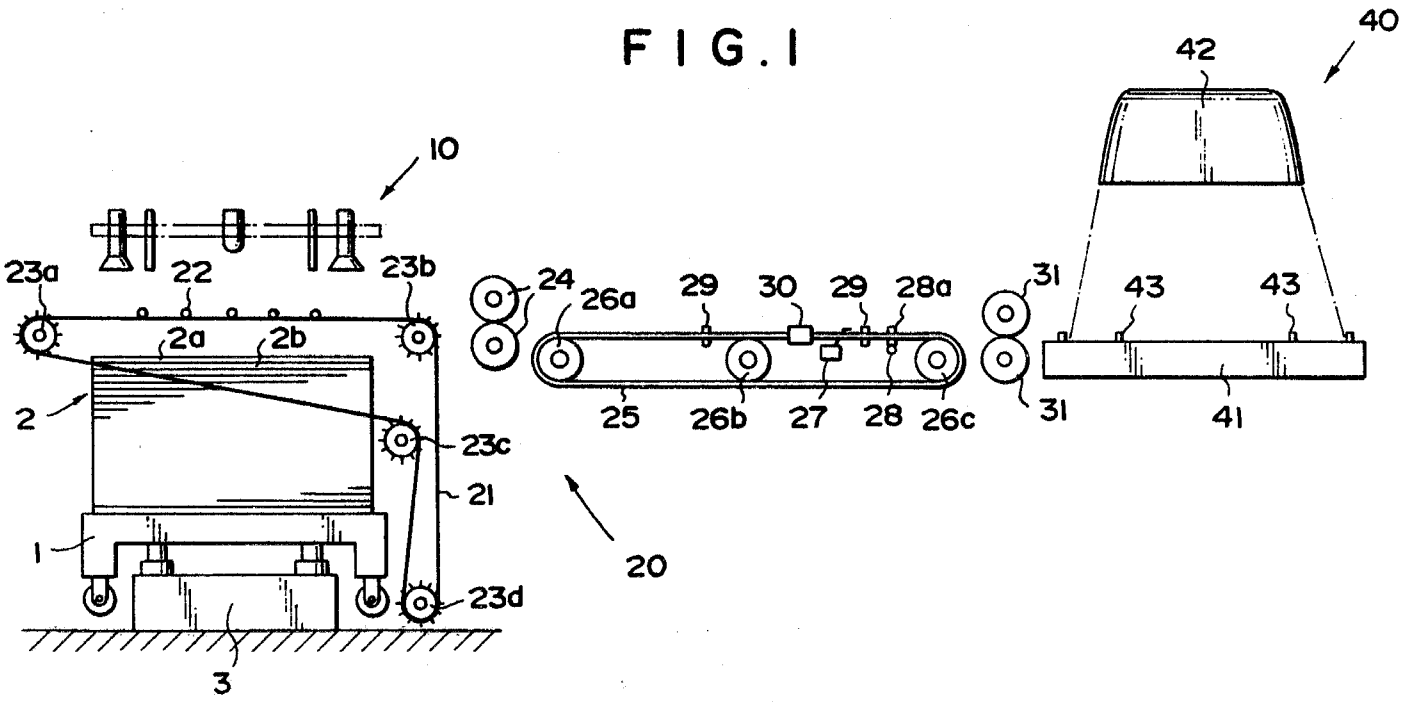
FIG. 1 is a side elevational view of a PS plate handling device in accordance with one embodiment of the present invention.
Figure 2:
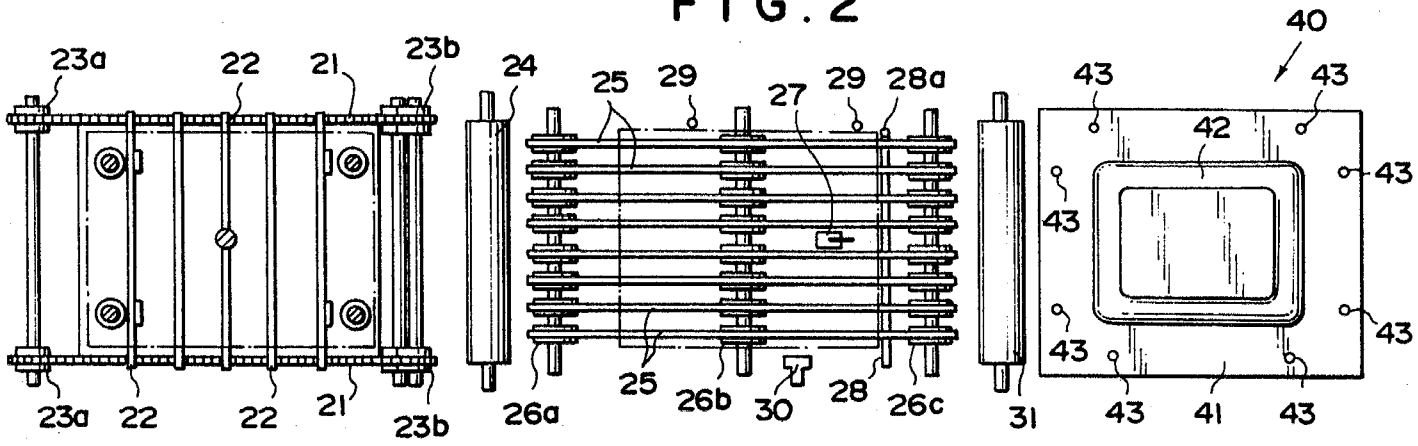
FIG. 2 is a plan view of the PS plate handling device of FIG. 1.

FIGS. 1 and 2 show a PS plate handling device in accordance with one embodiment of the present invention. The PS handling device illustrated in these figures is designed to separate aluminum-based PS plates one by one from a stack containing a large number of PS plates supported on a platform and feed then to a printing section.

As shown is FIGS. 1 and 2, the PS plate handling device of this embodiment comprises a platform 1 for supporting a stack 2 of PS plates thereon, a lifting means 3 for lifting the platform 1 upward so that the uppermost PS plate 2*a* in the stack 2 is always positioned at a predetermined level, a sucking and separating means 10 which separates the uppermost plate 2*a* from the rest of the stack 2 and a transferring and positioning means 20 for transferring the separated plate to a printing section 40.

The platform 1 is positioned in a predetermined position with respect to the lifting means 3. In operation, the lifting means 3 lifts the platform 1 to the height required to maintain the uppermost PS plate 2*a* at a predetermined level. This operation of the lifting means 3 is repeated everytime the uppermost PS plate in the stack 2 is removed. That is to say, when the PS plate 2*a* is removed, the platform 1 is raised to the extent required to bring the next PS plate 2*b* to the predetermined level, i.e., to the level at which the PS plate 2*a* was previously positioned. The lifting means 3 is controlled by, for example, an infrared position detecting means (not shown) which detects the upper edge of the stack 2.

Figure 7:
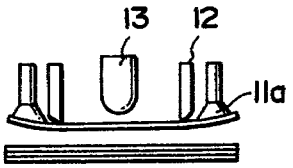

The sucking and separating means 10 lifts the uppermost PS plate away from the rest of the stack 2, as shown in FIG. 7, and delivers it to the transferring and positioning means 20 as will be described in more detail hereinbelow.

The transferring and positioning means 20 includes a pair of parallel endless chains 21 disposed on opposite sides of the stack 2 as shown in FIG. 2. The chains 21 pass around gears 23*a*, 23*b*, 23*c* and 23*d* in such manner as to run parallel to the surface of the stack 2 between the gears 23*a* and 23*b* as shown in FIG. 1. The gears of each of the gear pairs 23*a*, 23*b*, 23*c* and 23*d* for the chains 21 are mounted on common shafts. A plurality of transverse bar members 22 are connected to the respective chains 21 at the ends thereof so as to run together with the chains 21. The transverse bar members 22 are positioned in a first position away from the top of stack 2 when the sucking and separating means 10 is moved downward to access the stack 2 as will be described hereinbelow. After the sucking and separating means 10 has been moved upward to lift a separated PS plate, the transverse bar members 22 are moved to their second position between the stack 2 and the separating means 10 and the separating means 10 releases the separated PS plate so that it falls on the transverse bar members 22. The PS plate is then fed between a first pair of feed rollers 24 as the chains 21 and the transverse bar members 22 are moved rightward. The first pair of feed rollers 24 is rotated at a speed higher than the transferring speed of the chains 21, and delivers the PS plate to parallel endless belts 25. The endless belts 25 pass around left side pulleys 26*a*, intermediate pulleys 26*b* and right side pulleys 26*c*.

A front edge detecting means 27 comprising a microswitch is disposed between the intermediate pulleys 26*b* and the right side pulleys 26*c* and a front edge positioning means 28 is disposed between the front edge detecting means 27 and the right side pulleys 26*c*. The front edge positioning means 28 is a tranverse bar member extending perpendicularly to the endless belts 25 and mounted so as to be rotatable between a position above and a position below the endless belts 25 as shown in FIG. 1. The front edge positioning means 28 has a pair of conductive projections 28*a* located between the endless belts 25 which project upward above the upper surface of the endless belts 25. The left side surfaces of the peojections 28*a* are aligned normal to the direction of motion of the endless belts 25. The conductive projections 28*a* are connected to a control circuit (not shown) and serve as a pair of contacts, as will be described hereinbelow.

On one side of the endless belts 25 is disposed a side edge positioning means comprising a pair of conductive stopper members 29. On the other side of the endless belts 25 is disposed a movable side edge positioning means 30 which is moved toward the conductive stopper members 29 to push the PS plate being transferred by the endless belts 25 against the stopper members 29.

The endless belts 25 first transfer the PS plate delivered from the first pair of feed rollers 24 at a first speed equal to the feeding speed of the rollers 24 and the transferring speed of the endless belts 25 is lowered to a second speed which is lower than the first speed when the front edge of the PS plate reaches and actuates the front edge detecting means 27. Thus, as the PS plate is further transferred rightward at the lower second speed, the front edge thereof comes into engagement with the pair of conductive projections 28*a* of the front edge positioning means 28. When the front edge of the plate or the aluminum base thereof bridges the gap between the two conductive projections 28*a*, i.e., when the front edge has come into engagement with the projections 28*a* an consequently extends normal to the direction of motion of the endless belts 25, said movable side positioning means 30 is actuated to push one side edge of the PS plate until the other side edge comes into engagement with the pair of conductive stopper members 29. When the side edge of the PS plate has come to bridge the two conductive stopper members 29 so that the PS plate is positioned in two dimensions, a control circuit (not shown) returns the movable side edge positioning means 30 to its original position away from said one side edge of the PS plate, rotates the front edge positioning means 28 away from the front edge of the PS plate to retract the projections 28*a* thereof from the path of transfer of the PS plate so as to permit further advancement of the PS plate, and increases the speed of the endless belts 25 to the first speed.

The positioned PS plate is fed between a second pair of feed rollers 31 to be delivered to the printing section 40.

The printing section 40 comprises a printing stage 41 and a light source 42. The printing stage 41 is provided with positioning members 43 which are moved inwardly to position the delivered PS plate at a predetermined position and a sucking means (not shown) for retaining the delivered PS plate in the predetermined position.

The sucking and separating means 10 will now be described in detail with reference to FIGS. 2 to 7.

Figure 3:
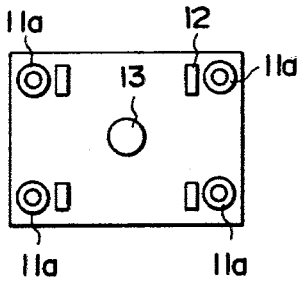
FIG. 3 is a plan view of a sucking and separating means showing the arrangement of the various members thereof.
Figure 4:
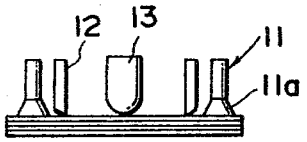
FIGS. 4 to 7 are side elevational views of the sucking and separating means of FIG. 3 showing the different stages of the separating operation thereof.

As shown in FIGS. 3 and 4, the sucking and separating means 10 comprises four sucking means 11 each having a sucker 11*a*, four first holding members 12 and a second holding member 13. Each sucker 11*a* is positioned to abut against the uppermost PS plate at a position adjacent to one of the four corners thereof; each of the first holding members 12 is positioned to abut the PS plate at a position inside the sucker 11*a* and adjacent thereto; and the second holding member 13 is positioned to abut the center of the PS plate when the sucking and separating means 10 is lowered as shown in FIG. 4.

Figure 5:
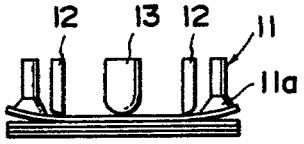
Figure 6:
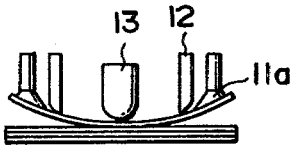

The sucking and separating means 10 is lowered to the stack 2. At this time the transverse bar members 22 are positioned in their first position wherein they are not below the sucking and separating means 10. Then, reduced pressure is imparted to the sucking means 11 whereby the suckers 11*a* suck the PS plate. The sucking means 11 are moved upward to lift the PS plate. At this time the first and second holding members 12 and 13 are still held in the lowered position to urge the PS plate downward. Accordingly, only the edge portion of the PS plate is lifted and thus the edge portion is deflected upward as shown in FIG. 5. Subsequently, the first holding members 12 are moved upward with the sucking means 11 being further moved upward and the second holding member 13 being still held in the lowered position. Thus, the uppermost PS plate is warpingly deflected upward about the second holding member 13 as shown in FIG. 6. Then, the second holding member 13 is moved upward whereby the uppermost PS plate is lifted away from the stack 2 as shown in FIG. 7.

As can be seen from FIGS. 5 to 7, an air gap is gradually formed between the uppermost PS plate and the next plate in the stack 2, and during the formation of the air gap, the uppermost PS plate together with the rest of the stack 2 is urged downward first by the first and second holding members 12 and 13 and later by the second holding member 13 alone. Thus the uppermost PS plate can be separated from the rest of the stack 2 without adversely moving the rest of the stack 2.

When the uppermost PS plate has been lifted, the chains 21 are driven to move the transverse bar members 22 to the second position below the sucking and separating means 10 and the feeding of reduced pressure to the sucking means 11 is terminated, whereby the PS plate sucked by the suckers 11*a* is released to fall onto the transverse bar member 22. Then, the PS plate is delivered to the printing section 40 through the first pair of feed rollers 24, the endless belts 25 and the second pair of feed rellers 31, as described above.

FIGS. 8 to 12 show various examples of the sucking and separating means which can be employed in the present invention, and are disclosed in Japanese Utility Model Publication Nos. 35(1960)-21232 and 43(1968)-14090, Japanese Utility Model Laid Open No. 53(1978)-67719, and Japanese Utility Model Publication Nos. 53(1978)-18795 and 35(1960)-19279, respectively.

Figure 8:
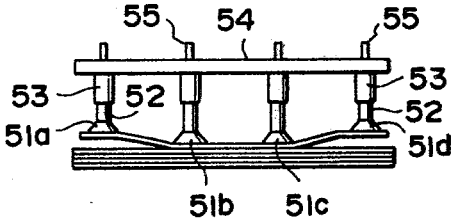
FIGS. 8 to 12 show various examples of a sucking and separating means which can be employed in the present invention.

The separating means shown in FIG. 8 includes suckers 51*a*, 51*b*, 51*c* and 51*d* each mounted on the lower end of a cylinder 52. Each cylinder 52 is slidably received in a sleeve 53 which is mounted on a support member 54 and connected to a suction source (not shown) by way of a suction pipe 55. The suckers 51*c* and 51*d* are disposed to abut the uppermost PS plate in the stack 2 at positions adjacent to the ends thereof, while the suckers 51*b* and 51*c* are disposed to abut intermediate portions of the PS plate.

When a reduced pressure is provided to the suckers 51*a* to 51*d* through the respective suction pipes 55 from the suction source, the uppermost PS plate is sucked against the suckers and at the same time the cylinders 52 are retracted more deeply into their respective sleeves 53 to lift the PS plate.

In operation, the outer pair of suckers 51*a* and 51*d* are first actuated to lift the corresponding portions of the PS plate. Thus, the edge portions of the PS plate are deflected upward to form an air gap between the uppermost PS plate and the next PS plate in the stack 2 as shown in FIG. 8. And then, the inner pair of suckers 51*b* and 51*c* are actuated to lift the uppermost PS plate entirely.

Figure 9:
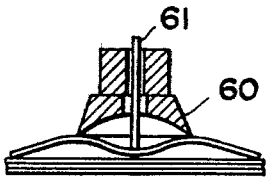

In the sucking means shown in FIG. 9, the sucking force of a sucker 60 is adjusted by means of a slide rod 61 slidably supported in a central bore of the sucker 60 so that only the one uppermost PS plate in the stack 2 is lifted by the sucker 60.

Figure 10:
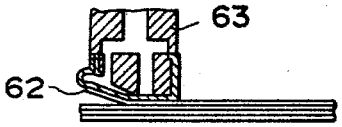

In another sucking means shown in FIG. 10, the outer edge portion 62 of a sucker 63 is deformed upward by suction force when provided with a reduced pressure, whereby the edge portion of the uppermost PS plate is deflected to form an air gap between the uppermost PS plate and the next PS plate in the stack 2.

Figure 11:
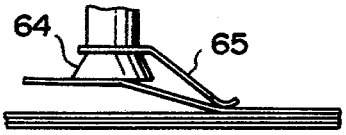

In still another sucking and separating means shown in FIG. 11, a holding member 65 which urges the stack 2 downward is mounted on a sucker 64 in order to prevent the next PS plate in the stack 2 from being lifted by the sucker 64.

Figure 12:
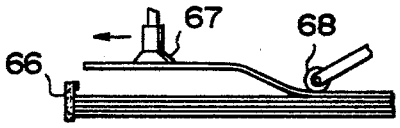

In another sucking and separating means shown in FIG. 12, a scraping member 66 is disposed adjacent to the front end of the stack of PS plates and a sucking means 67 is positioned to lift a portion of the uppermost PS plate adjacent to the front end. The scraping member 66 scrapes off the next PS plates so that it is not lifted together with the uppermost PS plate. A holding roller member 68 urges the rear end portion of the stack downward when the front end portion is lifted by the sucking means 67 and releases the stack when the sucking means 67 is moved in the direction shown by an arrow to feed out the uppermost PS plate.

Figure 13:
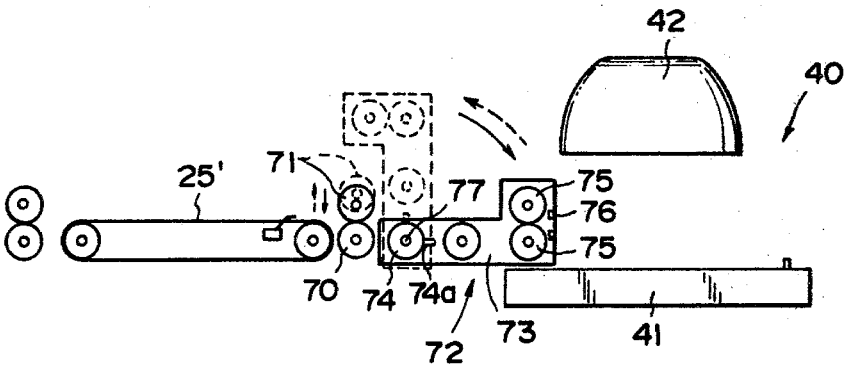
FIG. 13 shows a modified form of the transferring and positioning means employed in the present invention.

FIG. 13 shows a modification of the front edge positioning means. In FIG. 13, a fixed roller 70 and a movable roller 71 are disposed on the right side of endless belts 25' and a front edge positioning unit 72 is disposed between the rollers 70, 71 and the printing section 40. The front edge positioning unit 72 includes a bracket 73 upon which a front edge positioning stopper member 74 having a pair of conductive projections 74*a*, a pair of feed rollers 75 and a photoelectric detector 76 are mounted. The front edge positioning unit 72 is pivoted about the axis of the stopper member 74 by 90° between first and second positions shown by a dotted line and a solid line, respectively.

When the unit 72 is in the first position, said movable roller 71 is positioned in an ineffective position away from the fixed roller 70. In this position the rollers 70 and 71 do not feed the PS plate and the projections 74*a* of the stopper member 74 projects into the path of transfer of the PS plate. The function of the projections 74 is similar to that of the conductive projections 28*a* of FIG. 1.

When the positioning of the PS plate is completed, the unit 72 is pivoted to the second position to provide a PS plate transferring path therethrough with the projections 74*a* being retacted from the path. At the same time, the movable roller 71 is lowered to an effective position in contact with the fixed roller 70 and these two rollers feed the PS plate at a high speed toward the unit 72. The PS plate thus delivered to the unit 72 is further advanced to the printing section 40 by means of the feed rollers 75. When the photoelectric detector 76 detects the rear edge of the PS plate, the unit 72 is returned to its first position and the movable roller 71 is returned to its ineffective position.

We claim:

1. A presensitized plate handling device comprising a platform supporting thereon a stack of presensitized plates, a lifting means for lifting the platform so that the uppermost presensitized plate in the stack is always positioned at a predetermined level, a sucking and separating means which sucks and separates the uppermost presensitized plate away from the rest of the stack in which said sucking and separating means includes (a) sucker members which suck portions of the uppermost presensitized plate adjacent to the opposite ends thereof, (b) first holding members which hold the stack downward from above the uppermost presensitized plate at portions inward from and adjacent to the portions sucked by the sucker members and (c) at least one second holding member which holds the stack from above the uppermost presensitized plate at an intermediate portion between the ends, the sucker members, the first holding members and the second holding members being moved upward in this order when separating the uppermost presensitized plate from the rest of the stack, and a transferring means which transfers the separated presensitized plate to a processing section, said presensitized plate comprising an aluminum base and a photosensitive layer carried thereon and said transferring means including a transferring member for transferring the separated presensitized plate along a path of transfer, and positioning means including (a) a pair of conductive stopper members disposed on one side of the path of transfer in parallel thereto, (b) a movable side edge positioning member disposed on the other side of the path of transfer and (c) a pair of conductive front edge positioning members disposed in the path of transfer and aligned with each other in a direction normal to the direction of transfer, the movable side edge positioning member being movable to push the presensitized plate against the conductive stopper members to position the presensitized plate in the direction parallel to the direction of transfer when the front edge of the aluminum base makes electrical connection between the pair of conductive front edge positioning members, the movable side edge positioning member being returned to its original position and the pair of conductive front edge positioning members being retracted from the path of transfer when the pair of conductive stopper members are electrically connected by said aluminum base.

2. A presensitized plate handling device as defined in claim 1, in which the speed of transfer of the transferring means is lowered prior to the positioning of the presensitized plate.

3. A presensitized plate handling device comprising a platform supporting thereon a stack of presensitized plates, a lifting means for lifting the platform so that the uppermost presensitized plate in the stack is always positioned at a predetermined level, a sucking and separating means which sucks and separates the uppermost presensitized plate away from the rest of the stack in which said sucking and separating means comprises (a) at least one sucker member which sucks portions of the uppermost presensitized plate, and (b) at least one holding member which holds the stack downward from above the uppermost presensitized plate at portions adjacent to the portions sucked by the sucker member, the sucker member and the holding member being moved upward in this order when separating the uppermost presensitized plate from the rest of the stack, said presensitized plate comprising an aluminum base and a photosensitive layer carried thereon and said transferring means including a transferring member for transferring the separated presensitized plate along a path of transfer, and positioning means including (a) a pair of conductive stopper members disposed on one side of the path of transfer in parallel thereto, (b) a movable side edge positioning member disposed on the other side of the path of transfer and (c) a pair of conductive front edge positioning members disposed in the path of transfer and aligned with each other in a direction normal to the direction of transfer, the movable side edge positioning member being movable to push the presensitized plate against the conductive stopper members to position the presensitized plate in the direction parallel to the direction of transfer when the front edge of the aluminum base makes electrical connection between the pair of conductive front edge positioning members, the movable side edge positioning member being returned to its original position and the pair of conductive front edge positioning members being retracted from the path of transfer when the pair of conductive stopper members are electrically connected by said aluminum base.

4. A presensitized plate handling device as defined in claim 3, in which the speed of transfer of the transferring means is lowered prior to the positioning of the presensitized plate.

5. A presensitized plate handling device comprising a platform supporting thereon a stack of presensitized plates, a lifting means for lifting the platform so that the uppermost presensitized plate in the stack is always positioned at a predetermined level, a sucking and separating means which sucks and separates the uppermost presensitized plate away from the rest of the stack in which said sucking and separating means includes (a) sucker members which suck portions of the uppermost presensitized plate adjacent to the opposite ends thereof, (b) first holding members which hold the stack downward from above the uppermost presensitized plate at portions inward from and adjacent to the portions sucked by the sucker members and (c) at least one second holding member which holds the stack from above the uppermost presensitized plate at an intermediate portion between the ends, the sucker members, the first holding members and the second holding members being moved upward in this order when separating the uppermost presensitized plate from the rest of the stack, and a transferring means which transfers the separated presensitized plate to a processing section, said presensitized plate comprising an aluminum base and a photosensitive layer carried thereon and said transferring means including a transferring member for transferring the separated presensitized plate along a path of transfer, and positioning means including a pair of conductive front edge positioning members disposed in the path of transfer and aligned with each other in a direction normal to the direction of transfer, the pair of conductive front edge positioning members being retracted from the path of transfer when the front edge of the aluminum base makes electrical connection therebetween.

6. A presensitized plate handling device as defined in claim 5, in which the speed of transfer of the transferring member is lowered prior to the positioning of the presensitized plate.

7. A presensitized plate handing device comprising a platform supporting thereon a stack of presensitized plates, a lifting means for lifting the platform so that the uppermost presensitized plate in the stack is always positioned at a predetermined level, a sucking and separating means which sucks and separates the uppermost presensitized plate away from the rest of the stack in which said sucking and separating means comprises (a) at least one sucker member which sucks portions of the uppermost presensitized plate, and (b) at least one holding member which holds the stack downward from above the uppermost presensitized plate at portions adjacent to the portions sucked by the sucker member, the sucker member and the holding member being moved upward in this order when separating the uppermost presensitized plate from the rest of the stack, said presensitized plate comprising an aluminum base and a photosensitive layer carried thereon and said transferring means including a transferring member for transferring the separated presensitized plate along a path of transfer, and positioning means including a pair of conductive front edge positioning members disposed in the path of transfer and aligned with each other in a direction normal to the direction of transfer, the pair of conductive front edge positioning members being retracted from the path of transfer when the front edge of the aluminum base makes electrical connection therebetween.

8. A presensitized plate handling device as defined in claim 7, in which the speed of transfer of the transferring means is lowered prior to the positioning of the presensitized plate.

* * * * *